US009174256B2

(12) United States Patent
Tung et al.

(10) Patent No.: US 9,174,256 B2
(45) Date of Patent: Nov. 3, 2015

(54) HOT ROLLING HIGH-PRESSURE FLUID DESCALING METHOD AND DESCALING APPARATUS

(75) Inventors: Kun-Cheng Tung, Kaohsiung (TW); Chung-Ping Ju, Kaohsiung (TW); Pi-Kun Cheng, Kaohsiung (TW); Chao-Chi Huang, Kaohsiung (TW); Chun-Chao Shih, Kaohsiung (TW)

(73) Assignee: CHINA STEEL CORPORATION, Kaohsiung (TW)

( * ) Notice: Subject to any disclaimer, the term of this patent is extended or adjusted under 35 U.S.C. 154(b) by 702 days.

(21) Appl. No.: 13/401,045

(22) Filed: Feb. 21, 2012

(65) Prior Publication Data

US 2012/0216839 A1 Aug. 30, 2012

(30) Foreign Application Priority Data

Feb. 25, 2011 (TW) ..... 100106326 A

(51) Int. Cl.
*B08B 3/00* (2006.01)
*B21B 45/08* (2006.01)

(52) U.S. Cl.
CPC ..... *B21B 45/08* (2013.01)

(58) Field of Classification Search
None
See application file for complete search history.

(56) References Cited

FOREIGN PATENT DOCUMENTS

| | | | |
|---|---|---|---|
| CN | 201537629 | U | 8/2010 |
| EP | 1900449 | | 7/1997 |
| EP | 1900449 | B1 | 1/2010 |
| JP | 62-050812 | | 3/1987 |
| JP | 5-084406 | | 11/1993 |
| JP | 09-308909 | | 12/1997 |
| JP | 10-263677 | A | 10/1998 |
| JP | 09-174137 | | 3/2008 |
| JP | 2008-221328 | A | 9/2008 |
| JP | 2010-264498 | A | 11/2010 |

OTHER PUBLICATIONS

Office Action dated Feb. 26, 2014 by TIPO for the corresponding TW Patent Application No. 100106326.
Search Report issued on Feb. 26, 2014 by TIPO for the corresponding TW Patent Application No. 100106326.
English translation of the Search Report issued on Feb. 26, 2014 by TIPO for the corresponding TW Patent Application No. 100106326.
Office Action on Nov. 19, 2014 by TIPO for the corresponding TW Patent Application No. 100106326.
Office Action and the Search Report issued on May 29, 2013 by TIPO for the corresponding TW Patent Application No. 100106326 which cite JP2010-264498A, EP1900449B1, JP2008-221328A, and CN201537629U.

(Continued)

*Primary Examiner* — Eric Golightly
(74) *Attorney, Agent, or Firm* — WPAT, P.C.; Anthony King; Kay Yang

(57) ABSTRACT

The present invention relates to a hot rolling high-pressure fluid descaling method and descaling apparatus. The apparatus comprises at least one descaling unit, a axial direction of a main pipe header of the descaling unit and a rolling stock transportation direction intersect. Each nozzle ejects fluid onto a surface of the rolling stock to form an impact region. The adjacent impact regions are presented in an alternate pattern on the surface of the rolling stock. The center lines of the impact regions along a longitudinal direction are spaced apart by a specific distance, and the center lines are essentially perpendicular to the rolling stock transportation direction.

10 Claims, 10 Drawing Sheets

(56) References Cited

OTHER PUBLICATIONS

Office Action for KIPO counterpart application No. 10-2012-0019111 issued on Aug. 22, 2013 (with English translation) citing: JPH09-174137 (with English translation to Abstract), and EP1900449 (with English translation to Abstract).

Office Action for JP counterpart application No. 2012-037483 issued on Aug. 29, 2013 (with English translation) citing: JPH5-084406U, JPH9-308909A (with English translation to Abstract), and JPS62-050812U.

HOT ROLLING HIGH-PRESSURE FLUID DESCALING METHOD AND DESCALING APPARATUS

BACKGROUND OF THE INVENTION

1. Field of the Invention

The present invention relates to a descaling method and a descaling apparatus, more particular to a descaling method and a descaling apparatus that apply high-pressure fluid to remove the scale on the surface of semi-finished products (referred as rolling stock) in the hot rolling processes, such as the rolling of steel strip, steel plate, shaped steel, steel bar, wire rod, etc., for descaling purpose.

2. Description of the Related Art

In general, the scale on the surface of the rolling stock must be removed preceding rolling to prevent from the rolled-in-scale defects in a conventional hot rolling process such as for steel strip or steel plate. Therefore, a high-pressure fluid descaling apparatus is usually arranged before the rolling machine.

FIG. 1(*a*) shows the schematic drawing of the impact regions formed by the ejection of the nozzles of the conventional high-pressure fluid descaling apparatus; FIG. 1(*b*) shows the schematic drawing of the arrangement of the descaling apparatus; FIG. 1(*c*) shows the side view of a conventional high-pressure fluid descaling apparatus. In FIG. 1(*a*), B is the jet width, E is the nozzle distance, O is the overlapping, $\gamma$ is the offset angle of the nozzle axis against the header axis. In FIG. 1(*b*), $\alpha$ is the nozzle spray angle, and $\beta$, in FIG. 1(*c*) is the inclination (lead) angle.

As shown in FIGS. 1(*a*) to 1(*c*) for a conventional descaling apparatus, the inclination angle $\beta$ is to lead the scale upstream so as to prevent from rolled-in-defects in rolling stock such as the steel strip or the steel plate. In other words, general conventional descaling flushes the scales away against the rolling stock transportation direction, and the inclination angle $\beta$ is generally about 15°.

FIG. 2 shows the A-A cross-section of FIG. 1(*b*) about the overlapping of the jet spray of the conventional adjacent nozzles; FIG. 3 shows the rebounding of the jet spray of the conventional nozzles, in which X is the diverging angle due to the rebounding; FIG. 4 shows the usage of an aluminium plate in the erosion experiment of two adjacent impact regions, in which G is the width of the blank region and W is the width of the softened region after being eroded.

As shown in FIGS. 1(*a*) to 3, the jet curtains 12, 13 out of nozzles 11 are diverged by the offset angle $\gamma$ to prevent them from interfering with each other, thereby decreasing the uniformity of descaling. The impact regions 14, 15 on the surface of the rolling stock 10, which are formed by the jet curtains 12, 13 ejected by the consecutive nozzles 11, are partly overlapped so as to remove the scale evenly. However, having performed erosion test repetitively by using an aluminium plate as a testing plate, the testing results are not to the anticipation. It turns out as shown in FIG. 4 that the impact regions 14, 15 of the adjacent nozzles 11 do not overlap and there is a blank region (G) created, in which there is no erosion effect.

The blank region (G) occurs mainly because the rebounding fluid 16 from the jet curtain 13 behind the overlapped region interferes with the jet curtain 12 ahead of the overlapped region as shown in FIG. 2. Part of the jet curtain 12 may not effectively reach the overlapped region on the aluminium test plate; hence, the impact force is greatly reduced. Another important reason is that the rebounding fluid tends to extend towards two sides where there is less pressure. As a result, the rebounding fluid 16 will diverge outwardly as shown in FIG. 3.

In the blank region (G), only slight mark appears. In the softened region (W), rough surface is formed on the aluminium testing plate, whereas the width and depth of the erosion mark becomes narrower and shallower. In other words, the impact force or descaling effect to the blank region (G) and the softened region (W) is diminished due to the interference caused by the rebounding of the jet sprays from the adjacent nozzles.

The existence of the blank region (G) and the softened region (W) shows that the conventional high-pressure fluid descaling nozzles 11 are not adequately arranged, which is one of the main reasons why the scale is rolled in. However, in respect to the conventional technology, the problems are often deemed improper arrangement of the nozzles 11 or improper arrangement of the descaling apparatus, which causes the insufficient overlap of the impact regions 14 and 15.

Therefore, it is innovative to provide a high pressure fluid descaling method and apparatus for the hot rolling process to reduce the interference on the overlapped region, in which the rebounding fluid emerged from the jet curtains of the adjacent nozzles.

SUMMARY OF THE INVENTION

The present invention is directed to a high-pressure fluid descaling method and apparatus applied in hot rolling process, wherein the apparatus comprises at least one descaling unit, the at least one descaling unit comprising a main pipe header and a plurality of nozzles, wherein a projection of an axial direction of the main pipe header on a surface of the rolling stock and a rolling stock transportation direction intersects, and the main pipe header is used to supply a jet fluid. The nozzles are arranged on the main pipe header. Each nozzle is orientated towards a direction opposite to the rolling stock transportation direction so as to erode the scale off the surface of the rolling stock. The jet fluid ejected from the nozzles forms a plurality of impact regions on the surface of the rolling stock, of which the regions are alternately parallel to each other. The center lines of the impact regions along the longitudinal direction of the regions are evenly spaced apart and perpendicular to the rolling stock transportation direction.

The high-pressure fluid descaling method and descaling apparatus applied in hot rolling process according to the present invention can reduce the interference caused by the rebounding fluid from the jet curtains of the adjacent nozzles, thereby improving the descaling quality and reducing the scale on the surface of the rolling stock, which in turn improves the quality of the surface of the products. In practice, the invention can be applied to the hot rolling process such as to the steel strip, steel plate, shaped steel, steel bar and wire rod.

BRIEF DESCRIPTION OF THE DRAWINGS

FIG. 1(*b*) shows the schematic drawing of the arrangement of the conventional high-pressure fluid descaling apparatus;

FIG. 1(*c*) shows the side view of a conventional high-pressure fluid descaling apparatus;

FIG. 5(*b*) shows a schematic drawing of the arrangement of the descaling nozzles of the hot rolling high-pressure fluid descaling apparatus, according to the first embodiment of the present invention;

FIG. 5(*c*) shows a side view of the hot rolling high-pressure fluid descaling apparatus, according to the first embodiment of the present invention;

DETAILED DESCRIPTION OF THE INVENTION

Figure 1:
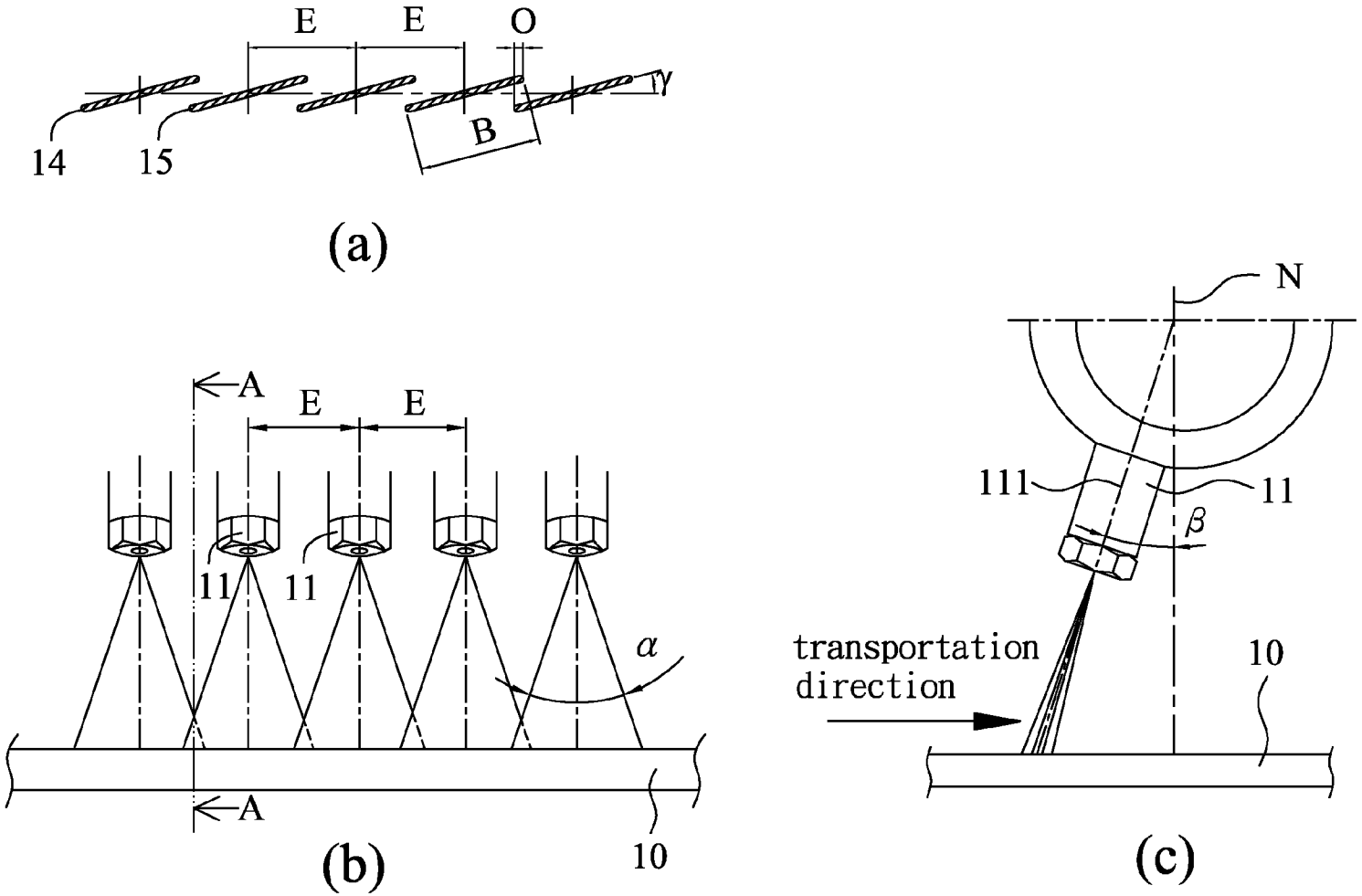
FIG. 1(Prior Art)
FIG. 1(*a*) shows the schematic drawing of the impact regions formed by the ejection of the nozzles of the conventional high-pressure fluid descaling apparatus.
Figure 2:
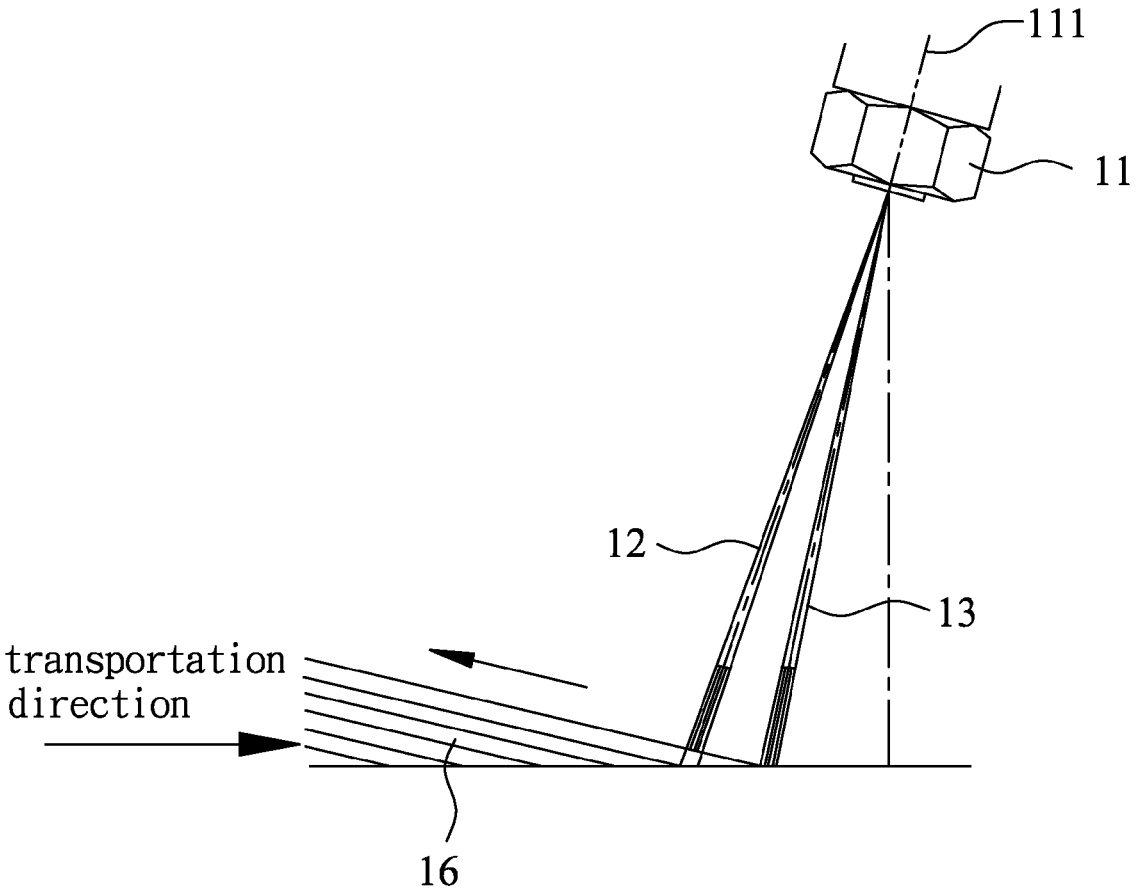
FIG. 2 (Prior Art)
FIG. 2 shows the A-A cross-section of FIG. 1(*b*) about the overlapping of the jet spray of the conventional adjacent nozzles.
Figure 3:
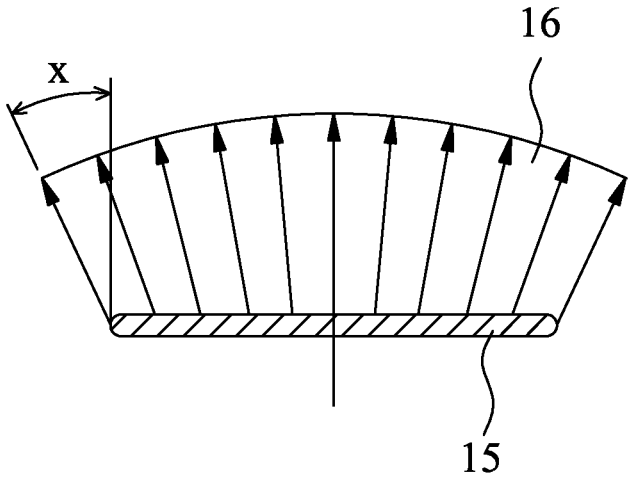
FIG. 3 (Prior Art)
FIG. 3 shows the rebounding of the jet spray of the conventional nozzles, in which X is the diverging angle due to the rebounding.
Figure 4:
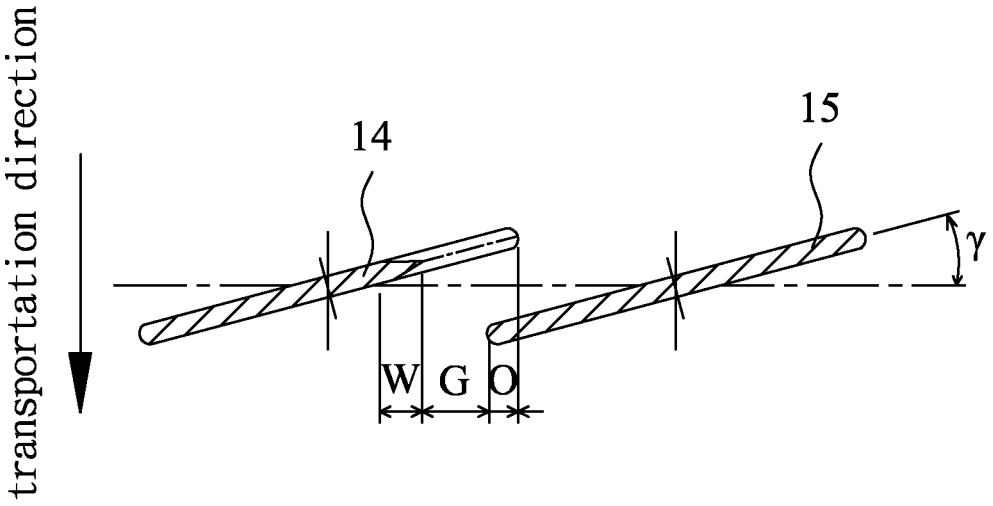
FIG. 4 (Prior Art)
FIG. 4 shows the usage of an aluminium plate in the erosion experiment of two adjacent impact regions.
Figure 5:
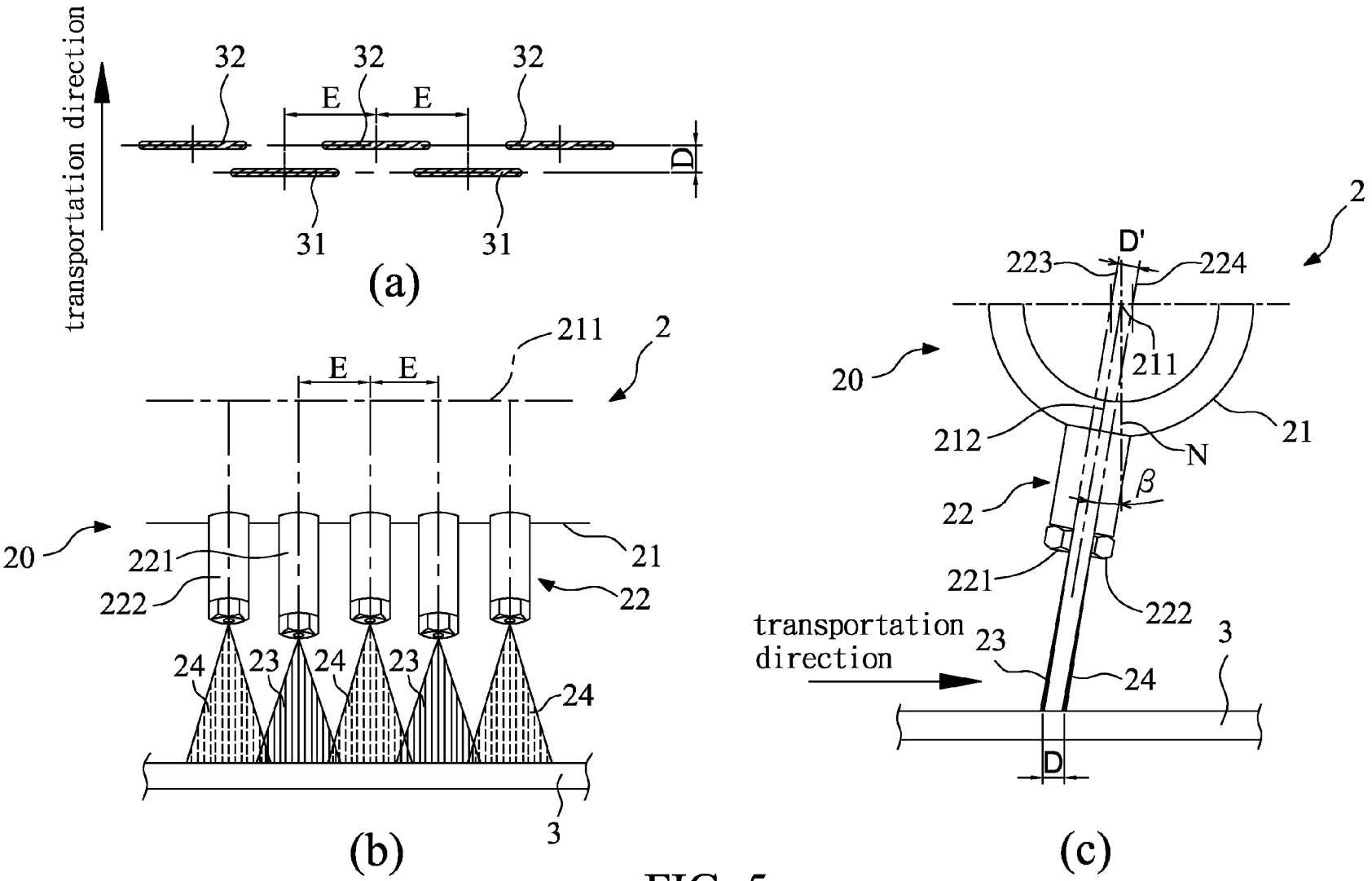
FIG. 5(*a*) shows the schematic drawing of the impact regions formed on the surface of the rolling stock by the jet curtains of the nozzles of the hot rolling high-pressure fluid descaling apparatus, according to a first embodiment of the present invention.

FIG. 5(*a*) shows a schematic drawing simulating the impact regions formed on the surface of the rolling stock by the jet curtains of the nozzles of the hot rolling high-pressure fluid descaling apparatus, according to a first embodiment of the present invention; FIG. 5(*b*) shows a schematic drawing of the arrangement of the descaling nozzles of the hot rolling high-pressure fluid descaling apparatus, according to the first embodiment of the present invention; FIG. 5(*c*) shows the side view of the hot rolling high-pressure fluid descaling apparatus, according to the first embodiment of the present invention.

As shown in FIGS. 5(*a*) to 5(*c*), the hot rolling high-pressure fluid descaling apparatus 2, according to the first embodiment of the present invention, comprises at least one descaling unit 20, wherein the descaling unit comprises a main pipe header 21 and a plurality of nozzles 22. A projection of a axial direction of the main pipe header 21 on the surface of the rolling stock and the rolling stock transportation direction of a rolling stock 3 intersect, and the main pipe header 21 is used to supply the jet fluid. In the embodiment of the invention, the axial direction of the main pipe header 21 is perpendicular to the rolling stock transportation direction. The rolling stock 3 can be strip, plate, billet, rod, bar, shaped beam, etc.

The nozzles 22 are arranged on the main pipe header 21. Each nozzle 22 is orientated towards a direction opposite to the rolling stock transportation direction; i.e., the direction of descaling jet by high-pressure fluid is opposite to the rolling stock transportation direction. In the embodiment of the invention, the nozzles 22 comprise a plurality of first nozzles 221 and a plurality of second nozzles 222 adjacent to the first nozzles 221.

The first nozzles 221 and the second nozzles 222 eject the fluid onto the surface of the rolling stock 3 so as to form a plurality of first impact regions 31 and a plurality of second impact regions 32 adjacent to the first impact regions 31, in which the two regions are alternately parallel to each other. The first impact regions 31 and the second impact regions 32 are overlapped in the rolling direction on the surface of the rolling stock 3. The center lines of the regions along the longitudinal direction of the regions are evenly spaced apart with a distance D and are perpendicular to the rolling stock transportation direction.

In the embodiment, the first nozzles 221 and the adjacent second nozzles 222 are spaced apart along the axial direction of the main pipe header 21 and arranged alternately; that is, the first nozzle 221 ejects jet curtain 23 and the adjacent second nozzle 222 ejects jet curtain 24, which form the impact region 31. The impact region 32 will be produced in the next impact area arranged by the consecutive nozzles. The nozzle and its adjacent nozzle will be arranged alternately. Hence, the impact regions occur respectively. (see FIGS. 5(*a*) and 5(*b*)).

Figure 6:
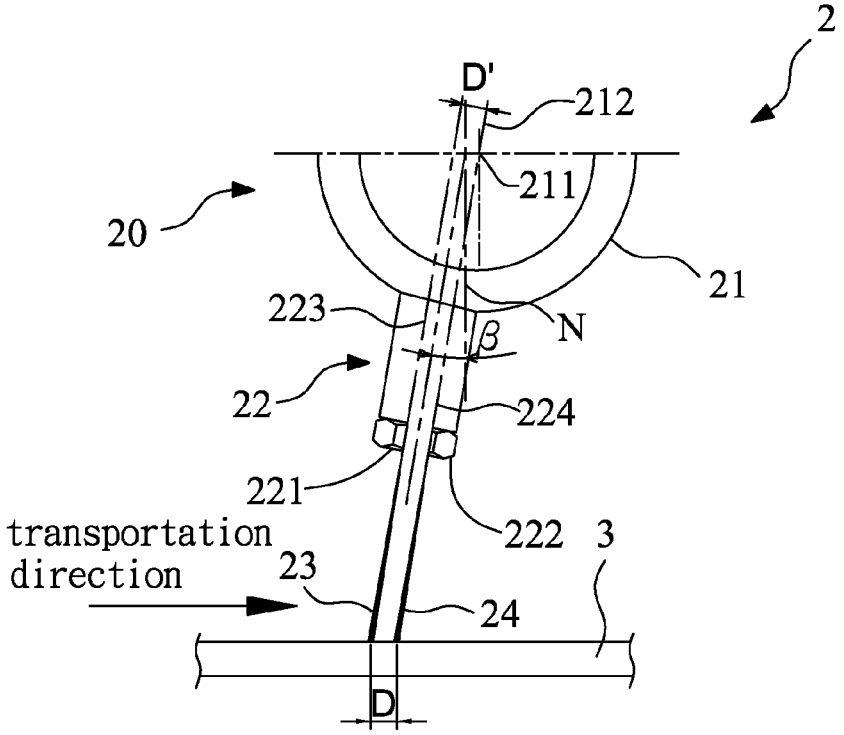
FIGS. 6 to 8 show schematic views of three different arrangements of the nozzles, according to the first embodiment of the present invention.

The positions of the first nozzles 221 and the second nozzles 222 may be arranged in a way that the center lines 223 of the first nozzles 221 and the center lines 224 of the adjacent second nozzles 222 are parallel to one another and symmetric to the radial line 212 passing through an axis of the main pipe header 21 (as shown in FIG. 5(*c*)). Alternatively, the center lines 223 of the first nozzles 221 and the center lines 224 of the adjacent second nozzles 222 are parallel to one another and symmetric to the radial line 212, which does not pass through the axis of the main pipe header 21 (as shown in FIG. 6, where the center lines 224 of the second nozzles 222 and the axis 211 of the main pipe header 21 intersect.)

In the arrangement where the center lines 223 of the first nozzles 221 and the center lines 224 of the second nozzles 222 are parallel to one another, D is the distance between the first impact regions 31 and the second impact regions 32; whereas, D' is the distance between the first nozzles 221 and the second nozzles 222, and β is the inclination angle that is between the center line of the first nozzles 221/the second nozzles 222 and the normal line of the surface of the rolling stock. The relation would be $D'=D\cos\beta$.

Figure 7:
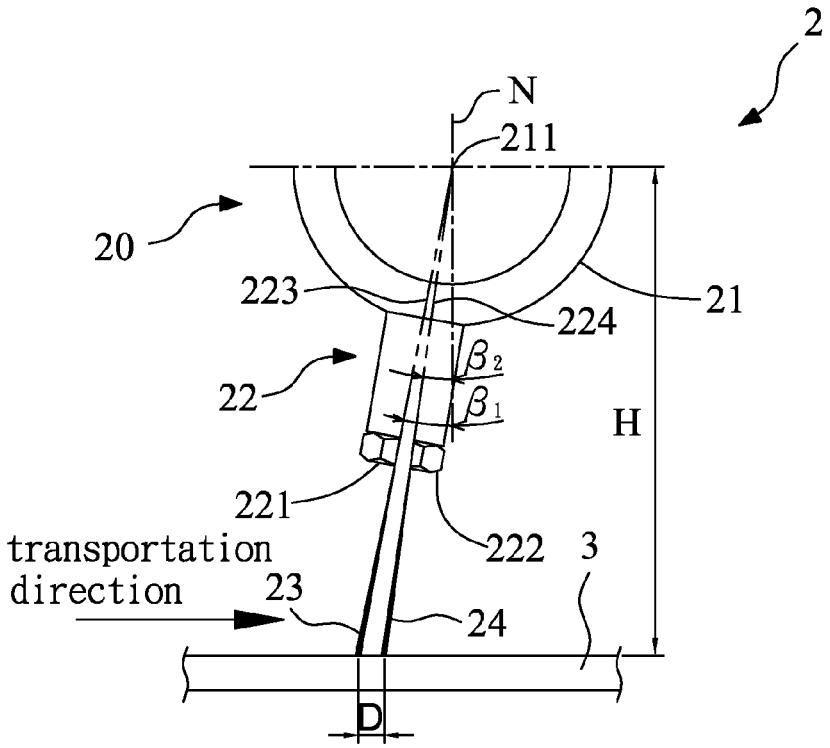
Figure 8:
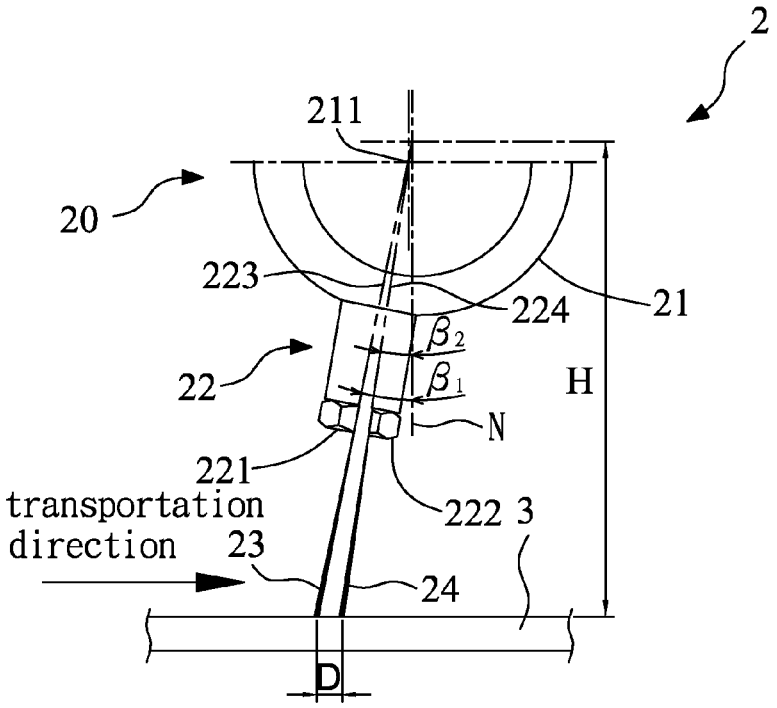

Alternatively, the positions of the first nozzles 221 and the second nozzles 222 may be arranged in a way that their corresponding center lines would not be parallel to one another. In this case, their center lines 223 and 224 may or may not intersect the axis 211 of the main pipe header 21 along the longitudinal direction (as shown in FIGS. 7 and 8).

In the arrangement, D is the distance between the first impact regions 31 and the second impact regions 32; whereas, H is the distance from the surface of the rolling stock to the intersection of center lines 223 and 224. β1 is the first inclination angle between the center line 223 of the first nozzle 221 and the normal line of the surface of the rolling stock; whereas, β2 is the second inclination angle between the center line 224 of the second nozzle 222 and the normal line of the surface of the rolling stock. The relation would be $D=H(\sin\beta1-\sin\beta2)$.

Figure 9:
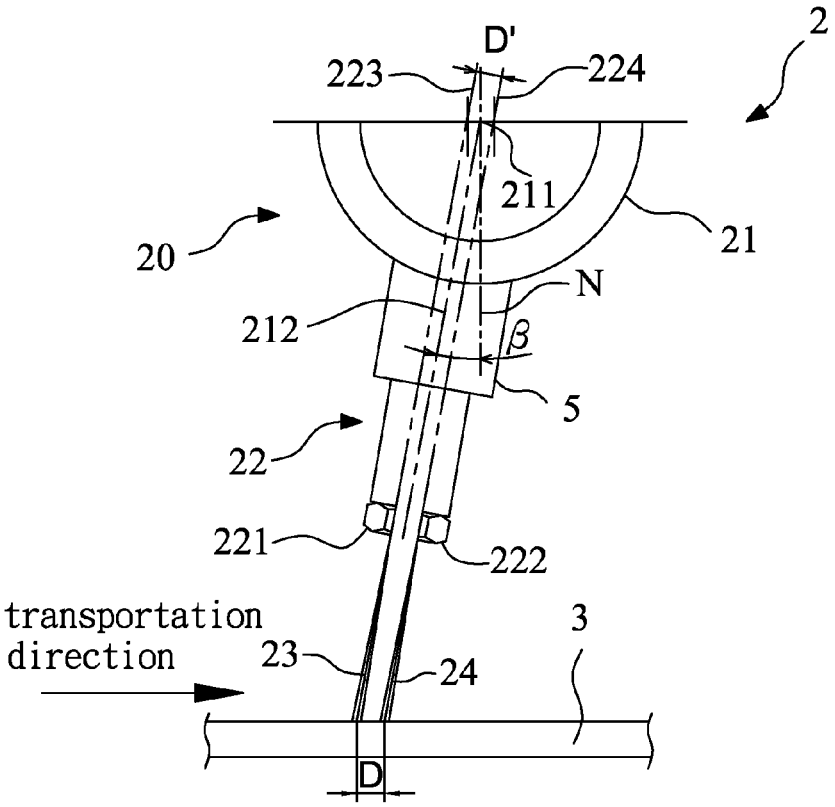
FIGS. 9 and 10 show schematic views of the hot rolling high-pressure fluid descaling apparatus with an extended portion, according to the first embodiment of the present invention.
Figure 10:
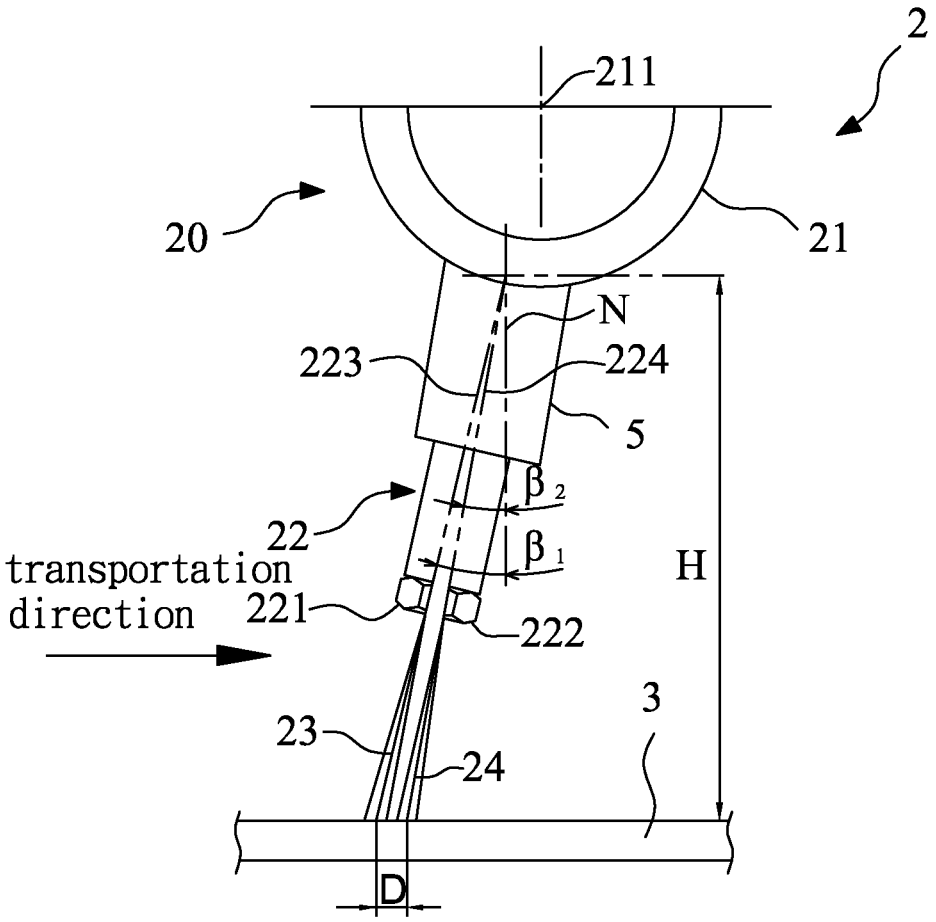

Moreover, as shown in FIGS. 9 and 10, the hot rolling high-pressure fluid descaling apparatus 2, according to the present invention, may further comprise an extended portion 5, which is regarded as a pillar (such as a square pillar or a cylinder). The extended portion 5 may either in the form of only one piece connect all the nozzles 22 to the main pipe header 21, or at least one piece connect one or more than one nozzle 22 to the main pipe header 21. In the hot rolling high-pressure fluid descaling apparatus 2 with the extended portion 5, the center lines 223 of the first nozzles 221 and the center lines 224 of the adjacent second nozzles 222 may or may not be parallel to one another (as shown in FIGS. 9 and 10).

The extended portion 5 added to each single nozzle is more suitable for the larger distance between nozzles 22; whereas, the extended portion 5 added as a lump unit to more than one nozzle 22 is more suitable for the smaller distance between nozzles 22.

Figure 11:
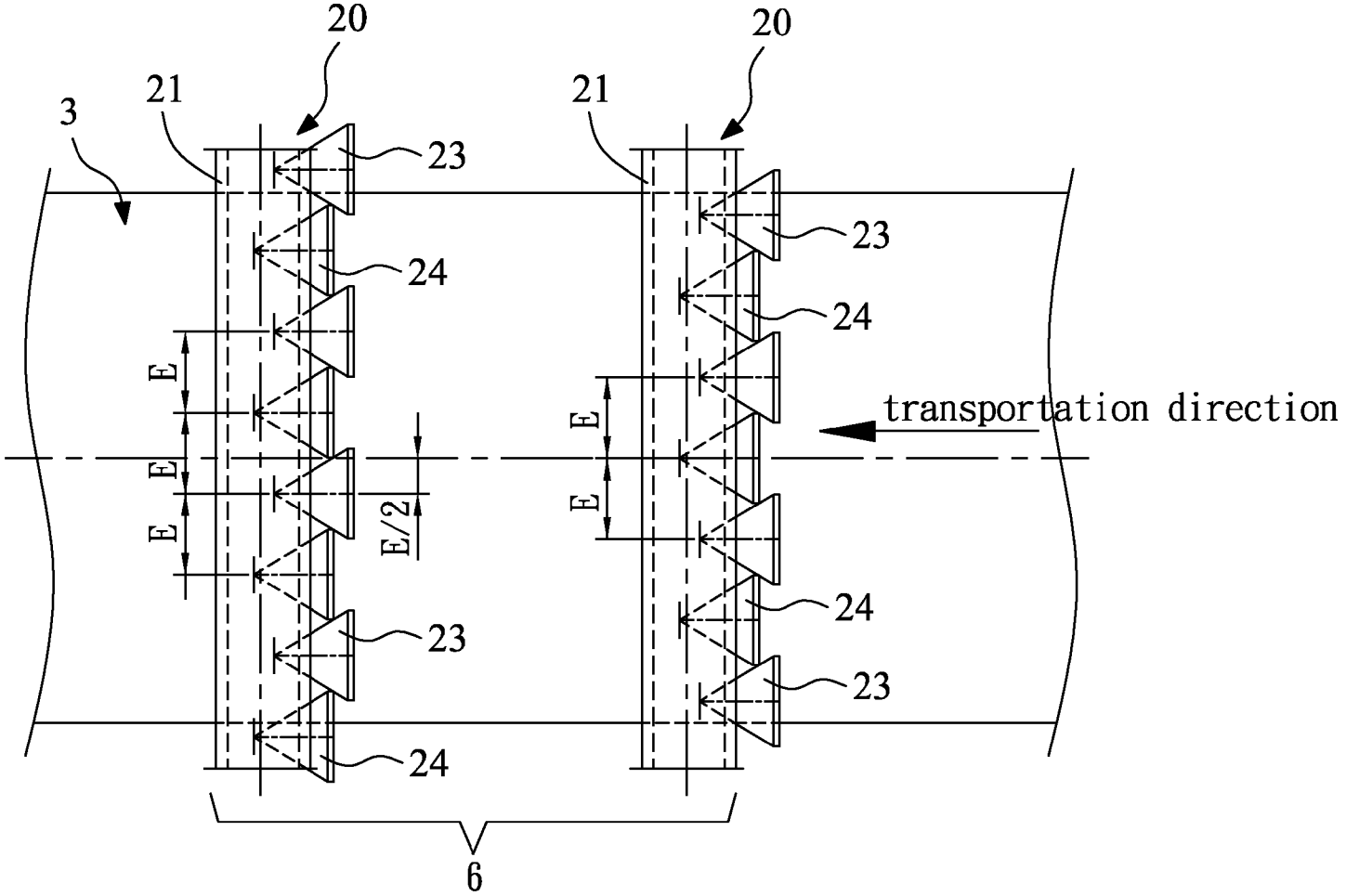
FIG. 11 shows a schematic view of a hot rolling high-pressure fluid descaling apparatus, according to a second embodiment of the present invention.

FIG. 11 shows a schematic drawing of a hot rolling high-pressure fluid descaling apparatus based on the second embodiment of the present invention. The descaling apparatus 6 comprises two rows of descaling unit 20 as mentioned in FIG. 5(*c*), wherein the center lines of the nozzles 22 in the front descaling unit 20 are preferably arranged one half of the nozzle distance E offset to the corresponding nozzles in the rear descaling unit. In the embodiment of the invention, the components, which are the same as those of the hot rolling high-pressure fluid descaling apparatus 2 in the first embodiment, are designated by the same reference numbers and will not be described again. It is understood that the two descaling units 20 are identical to each other and may be regarded as either one of the drawings shown in FIGS. 6 to 10.

Figure 12:
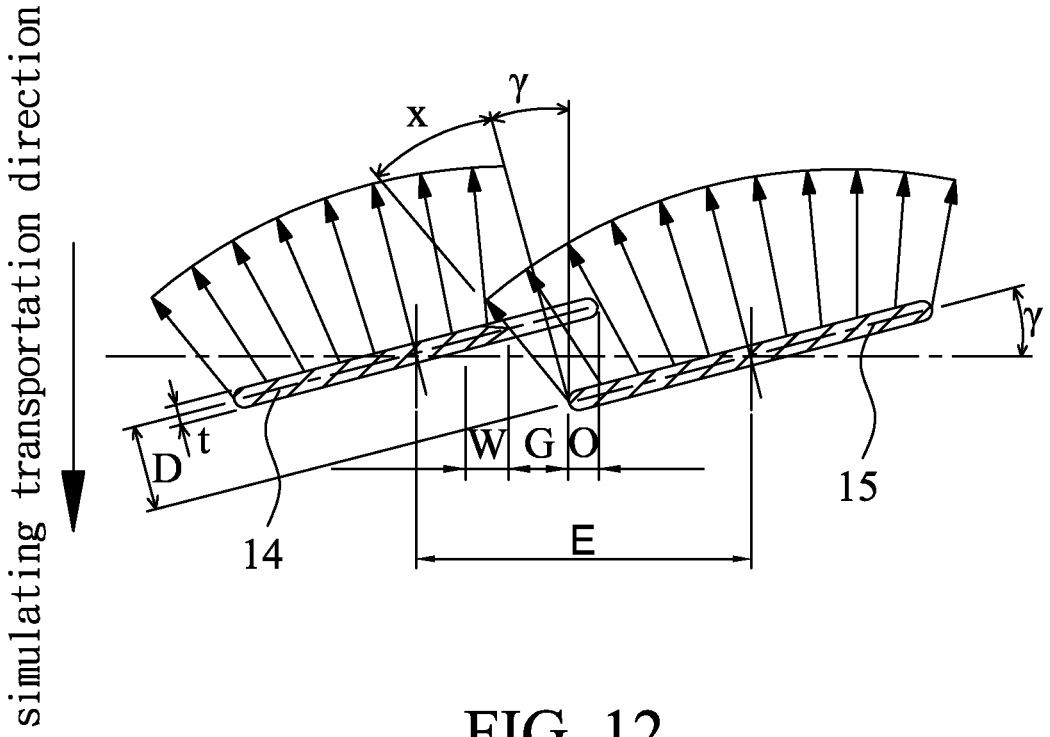
FIG. 12 shows a schematic drawing simulating the erosion marks formed on the surface of an aluminium plate by the jet curtains of the adjacent nozzles based on the arrangement of the nozzles of the conventional experiment which uses an aluminium plate as a testing plate.

FIG. 12 shows a schematic drawing simulating the erosion marks formed on the surface of the rolling stock by the jet spray based on the experiment with conventional high-pressure fluid descaling apparatus, which uses an aluminium plate as a testing plate. The geometry relationship between the adjacent impact regions 14 and 15 is as follows:

$$D = E\sin\gamma \tag{1}$$

$$G = \frac{E\sin\gamma}{\cos X}\sin(X+\gamma) \tag{2}$$

$$G = \frac{D}{\cos X}\sin(X+\gamma) \tag{3}$$

Where:

X is the diverging angle due to the rebounding of the jet spray; D is the perpendicular distance between the adjacent impact regions 14 and 15; E is distance between the center line of the adjacent nozzles along the axial direction of the main pipe header; G is the width of the blank region (region without being eroded) between the adjacent impact regions 14 and 15 on the surface of an aluminium plate; γ is the offset angle, which is the angle between the longitudinal direction of the impact regions 14 and 15 and the direction perpendicular to the rolling stock transportation direction; and O is the width of the overlapping region between the adjacent impact regions 14 and 15.

It is understood from Formula (2) that the greater the nozzle distance E is, the wider the blank region G is and vice versa. One can also find from Formula (2) that the greater the offset angle γ is, the wider the blank region G is and vice versa.

Figure 13:
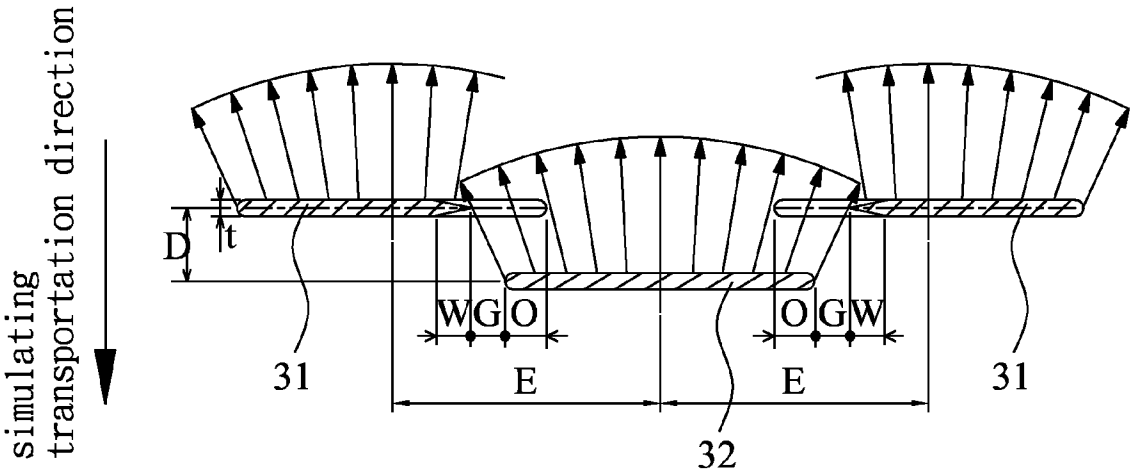
FIGS. 13 to 14 show schematic views simulating the erosion marks formed on the surface of an aluminium plate by the jet curtains of the adjacent nozzles based on present invention.
Figure 14:
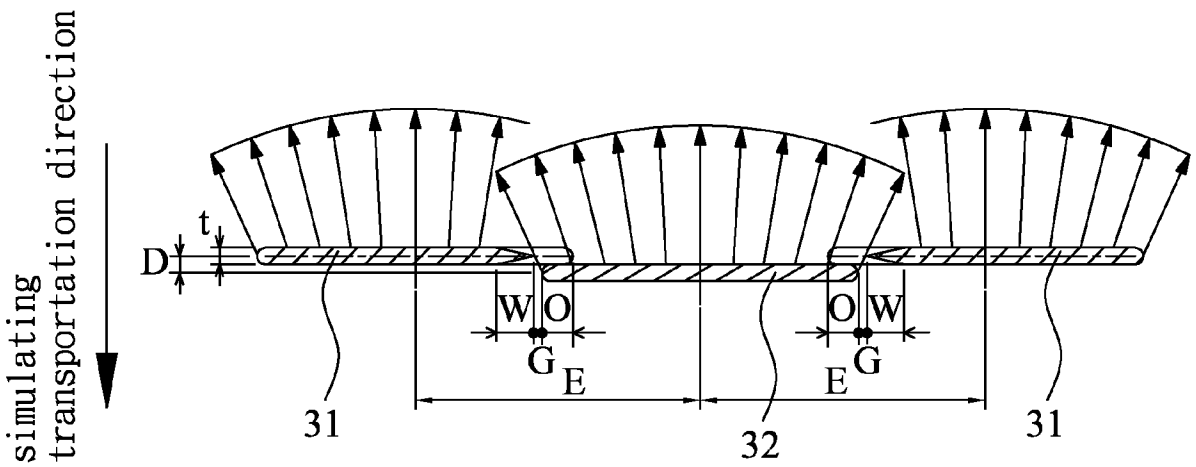

FIGS. 13 to 14 show schematic drawings simulating the erosion marks formed on the surface of an aluminium plate by the jet spray of the adjacent nozzles, according to the present invention. Referring to FIGS. 5(*a*) to 5(*c*) and FIGS. 13 to 14, the arrangement of the nozzles 22 of the descaling apparatus 2, including the first nozzles 221 and the adjacent second nozzles 222, creates impact regions 31 and 32 from the corresponding first nozzles 221 and second nozzles 222, according to the present invention. The impact regions 31 and 32 emerge on the rolling stock 3 alternately, wherein impact regions 31 and 32 are parallel to one another, that is, the offset angle γ approaches zero. Generally, the offset angle γ of the nozzles is 15° in conventional design. Compared with the conventional design, the hot rolling high-pressure fluid descaling apparatus, according to the present invention, can effectively reduce the width of the blank region under the same distance D between the impact regions, and thus improves the descaling quality.

When the offset angle γ approaches zero (γ≈0), one can deduce from Formula (3) that $$G = D\tan X \tag{4}$$

The width of the blank region G depends on the diverging angle X of the rebounding fluid and the distance D between the impact regions 31 and 32.

It is derived from Formula (4). When D≈t (as shown in FIG. 10), $$G = t\tan X \tag{5}$$

The width of the blank region G is to the minimum theoretically. Yet, due to the errors accumulated from the manufacturing, assembling and the installing of the whole descaling unit 20, the distance D between the impact regions may become smaller than t. The jet spray 23 and the jet spray 24 may also interfere with each other, thereby increase the width of the blank region G. As described previously in the present invention, the relationship between the parameters t, D and E is preferred to be regulated as following:

$$t < D \leq E\sin 15°.$$

Table 1 is a comparison of erosion experiments by the descaling apparatus between the present invention and the conventional one.

One can find in the Table 1 that the width of the blank region G is obviously reduced in the present invention compared with that in the conventional test. Hence, the arrangement of the nozzles 22 of the descaling apparatus 2 according to the present invention can effectively improve the descaling quality.

TABLE 1

Comparisons of the erosion experiments by the descaling apparatus between the present invention and the conventional one:

| | Conventional descaling apparatus | | Descaling apparatus according to the present invention | |
|---|---|---|---|---|
| D | 9t (γ = 15°) | 6t (γ = 10°) | 6t (γ≈0°) | 2.5t (γ≈0°) |
| G | 15 mm | 12 mm | 6.5 mm | 3.5 mm |

The present invention is also a method applicable to hot rolling high-pressure fluid descaling practices. In the embodiment, the hot rolling high-pressure fluid descaling apparatus 2 is used to conduct hot rolling descaling as shown in FIG. 5(*b*), FIG. 5(*c*), FIG. 11 and FIG. 13. With the hot rolling high-pressure fluid descaling method, according to the present invention, a fluid in the main pipe header 21 of the descaling unit 20, which can be more than one set, via the nozzles 22 including the first nozzles 221 and the adjacent second nozzles is used to form a plurality of corresponding first jet sprays 23 and the adjacent second jet sprays 24, which are orientated towards the direction opposite to the rolling stock transportation direction and ejected to the surface of the rolling stock 3 so as to clean off the scale. The first jet sprays 23 and the second jet sprays 24 form corresponding impact regions 31 and 32 on the surface of the rolling stock 3.

The first impact regions 31 and the adjacent second impact regions 32 are essentially parallel to one and another and distributed alternately on the surface of the rolling stock 3. The impact regions 31 and 32 overlap along the rolling stock transportation direction, of which the center lines of the impact regions along the longitudinal direction are spaced apart with a impact distance D. The longitudinal direction of the impact regions is essentially perpendicular to the rolling stock transportation direction. Preferably, the fluid is ejected onto the surface of the rolling stock 3 through the nozzles 22 with a inclination (lead) angle between 5° and 45°.

The hot rolling high-pressure fluid descaling method, according to the present invention, may also apply the hot rolling high-pressure fluid descaling apparatus 6 with two rows of descaling units 20 to conduct descaling for the rolling stock 3 as shown in FIG. 11. The fluid in the main pipe headers 21 of two descaling units 20 is ejected to the surface of the rolling stock 3 through the nozzles 22 of the the descaling units 20, wherein the center lines of the nozzles 22 of the two descaling units 20 are arranged alternately and spaced apart with one half of the nozzle distance E.

For the hot rolling high-pressure fluid descaling method and descaling apparatus, according to the present invention, when the offset angle approaches zero and the width of the original overlapped impact region is unchanged, the descaling impact force can be enhanced by reducing the spray angle; alternatively, the distance between nozzles can be increased to reduce the number of the nozzles being arranged, hence save the consumption of descaling fluid and improve the descaling efficiency.

The hot rolling high-pressure fluid descaling apparatus, according to the present invention, may have one descaling unit or two descaling units, which may be applied for the removing of scale before the rolling machine, the mill descaling PSB (Primary Scale Breaker) or FSB (Finishing Scale Breaker) so as to enhance the descaling. The hot rolling high-pressure fluid descaling apparatus, according to the present invention, forms the impact regions on the surface of the rolling stock, which are parallel to one another. The interference caused by the rebounding fluid from the jet sprays of the adjacent nozzles is reduced to the minimum, so as to reduce the width of the blank region. Moreover, when the descaling apparatus comprises two rows of descaling unit, the center lines of the nozzles in the front descaling unit are preferably arranged one half of the nozzle distance E offset to the corresponding nozzles in the rear descaling unit, which solves the problem of the blank regions produced via the interference of the jet sprays from the adjacent nozzles.

Therefore, the hot rolling high-pressure fluid descaling method and descaling apparatus, according to the present invention, can improve the descaling quality, reduce the roll-in-scale in the surface of the products and therefore improve the surface quality of the products. In practice, the hot rolling high-pressure fluid descaling method and descaling apparatus, according to the present invention, can be applied to the hot rolling processes such as for steel strip, steel plate, shaped steel, steel bar and wire rod.

While several embodiments of the present invention have been illustrated and described, various modifications and improvements can be performed by those skills in the art. The embodiments of the present invention are therefore described in an illustrative yet not restrictive sense. The intention is that the present invention should not be limited to the particular forms as illustrated, and all the modifications that maintain the spirit and the scope of the present invention are within the scope of the appended claims.

We claim:

1. A hot rolling high-pressure fluid descaling apparatus, comprising at least one descaling unit, wherein the at least one descaling unit comprises:

a main pipe header, wherein a projection of an axial direction of the main pipe header on a surface of a rolling stock and a rolling stock transportation direction intersect, and the main pipe header is used to supply a fluid; and a plurality of nozzles, arranged on the main pipe header, wherein each nozzle is orientated towards a direction opposite to the rolling stock transportation direction and ejects the fluid onto the surface of the rolling stock so as to form an impact region, the adjacent impact regions are essentially parallel to one another and presented in an alternate pattern on the surface of the rolling stock, a center line of each impact region along a longitudinal direction of the impact region itself is spaced apart between its adjacent impact region by a specific distance, and a projection of the center line on the rolling stock is essentially perpendicular to the rolling stock transportation direction, wherein the center lines of the adjacent nozzles are parallel to one another; wherein D is the perpendicular distance between the adjacent impact regions, D' is the distance between the front and rear staggered nozzles, and β is the inclination angle that is between the center line of the nozzles and the normal line of the surface of the rolling stock, and the relationship is D'=D cosβ; wherein the geometry relationship between the adjacent impact regions is as follows:

$$D = E\sin\gamma; \tag{1}$$

$$G = \frac{E\sin\gamma}{\cos X}\sin(X+\gamma); \tag{2}$$

$$G = \frac{D}{\cos X}\sin(X+\gamma); \tag{3}$$

where X is the diverging angle due to the rebounding of the jet spray; E is distance between the center line of the adjacent nozzles along the axial direction of the main pipe header; G is the width of the blank region between the adjacent impact regions; γ is the offset angle, which is the angle between the longitudinal direction of the impact regions and the direction perpendicular to the rolling stock transportation direction; and the offset angle approaches zero.

2. The apparatus as claimed in claim 1, wherein the nozzles are spaced apart along the axial direction of the main pipe header and arranged in a staggered pattern.

3. The apparatus as claimed in claim 1, wherein the center lines of the adjacent nozzles are symmetric with reference to a radial line passing through an axis of the main pipe header or not symmetric.

4. The apparatus as claimed in claim 1, wherein the center lines of the adjacent nozzles are not parallel to one another.

5. The apparatus as claimed in claim 4, wherein H is the distance from the surface of the rolling stock to the intersection of the center lines of the adjacent nozzles, β1 is a first inclination angle between the center line of nozzle and the normal line of the surface of the rolling stock, β2 is a second inclination angle between the center line of the adjacent nozzle and the normal line of the surface of the rolling stock, the relationship is $D=H(\sin\beta 1-\sin\beta 2)$.

6. The apparatus as claimed in claim 1, wherein t is the thickness of the impact regions and the relationship is $t<D\leq E\sin 15°$.

7. The apparatus as claimed in claim 5, wherein t is the thickness of the impact regions and the relationship is $t<D\leq E\sin 15°$.

8. The apparatus as claimed in claim 1, further comprising an extended portion, wherein the extended portion is arranged between all the nozzles and the main pipe header.

9. The apparatus as claimed in claim 1, further comprising a plurality of extended portions, wherein each extended portion is arranged between at least one nozzle and the main pipe header.

10. The apparatus as claimed in claim 1, comprising two descaling units, wherein the center lines of the nozzles of two descaling units are arranged in an alternate pattern and spaced apart with one half of the nozzle distance between the nozzles of a front descaling unit and the corresponding adjacent nozzles of a rear descaling unit.

* * * * *